US010756454B2

(12) United States Patent
Foser

(10) Patent No.: US 10,756,454 B2
(45) Date of Patent: Aug. 25, 2020

(54) EARTHING CONTACT

(71) Applicant: HILTI AKTIENGESELLSCHAFT, Schaan (LI)

(72) Inventor: Thomas Foser, Balzers (LI)

(73) Assignee: HILTI AKTIENGESELLSCHAFT, Schaan (LI)

( * ) Notice: Subject to any disclaimer, the term of this patent is extended or adjusted under 35 U.S.C. 154(b) by 0 days.

(21) Appl. No.: 16/485,596

(22) PCT Filed: Apr. 17, 2018

(86) PCT No.: PCT/EP2018/059714
§ 371 (c)(1),
(2) Date: Aug. 13, 2019

(87) PCT Pub. No.: WO2018/192899
PCT Pub. Date: Oct. 25, 2018

(65) Prior Publication Data

US 2020/0028283 A1 Jan. 23, 2020

(30) Foreign Application Priority Data

Apr. 18, 2017 (EP) ..... 17166858

(51) Int. Cl.
*H01R 4/66* (2006.01)
*H01R 4/30* (2006.01)
(Continued)

(52) U.S. Cl.
CPC ..... *H01R 4/66* (2013.01); *H01R 4/30* (2013.01); *H01R 4/646* (2013.01); *H01R 11/12* (2013.01)

(58) Field of Classification Search
CPC .... H01R 4/64; H01R 13/4532; H01R 25/142; H01R 13/65802; H01R 4/646; H01R 13/6658
(Continued)

(56) References Cited

U.S. PATENT DOCUMENTS 3,942,466 A * 3/1976 Bunyan ..... G01L 5/12 440/83
9,214,758 B2 * 12/2015 Matuschek ..... H01R 13/5202
(Continued)

FOREIGN PATENT DOCUMENTS

CN 103180623 A 6/2013
CN 103967916 A 8/2014
(Continued)

OTHER PUBLICATIONS

International Bureau, International Search Report in International Application No. PCT/EP2017/059714, dated May 15, 2018.

*Primary Examiner* — Phuong Chi Thi Nguyen
(74) *Attorney, Agent, or Firm* — Leydig Voit & Mayer, Ltd.

(57) ABSTRACT

An earthing contact for creating an electrical contact between an earthing cable and a component comprising an electroconductive component surface, comprises an electroconductive contact plate and a fixing element, the contact plate having a first contact surface for placing the contact plate on the component surface, a second contact surface for placing an earthing cable on the contact plate, and a passage for the fixing element, the fixing element comprising a fixing section for fixing the fixing element in the component, a pressure element for pressing the contact plate onto the component surface and a holding section for arranging in the passage of the contact plate, when the pressure element presses the contact plate onto the component surface, the first contact surface being tiltable in relation to the fixing
(Continued)

section by a tilting angle of at least 6° when the holding section is arranged in the passage.

20 Claims, 1 Drawing Sheet

(51) Int. Cl.
*H01R 4/64* (2006.01)
*H01R 11/12* (2006.01)

(58) Field of Classification Search
USPC ..... 439/620, 939, 92–100, 108
See application file for complete search history.

(56) References Cited

U.S. PATENT DOCUMENTS

| | | | | |
|---|---|---|---|---|
| 9,261,130 | B2 | 2/2016 | Hirayama | |
| 9,316,248 | B2 | 4/2016 | Appl et al. | |
| 2004/0104559 | A1* | 6/2004 | Chen | A61H 3/04 280/642 |
| 2005/0153586 | A1 | 7/2005 | Girinon | |
| 2005/0269120 | A1 | 12/2005 | Guarino et al. | |
| 2012/0122328 | A1 | 5/2012 | Buhri et al. | |
| 2016/0156111 | A1 | 6/2016 | Forsyth | |

FOREIGN PATENT DOCUMENTS

| | | | |
|---|---|---|---|
| CN | 106089933 | A | 11/2016 |
| DE | 602005005860 | T2 | 5/2009 |
| DE | 202015106468 | U1 | 12/2015 |
| EP | 2451012 | A2 | 5/2012 |
| JP | 2013004459 | A | 1/2013 |

* cited by examiner

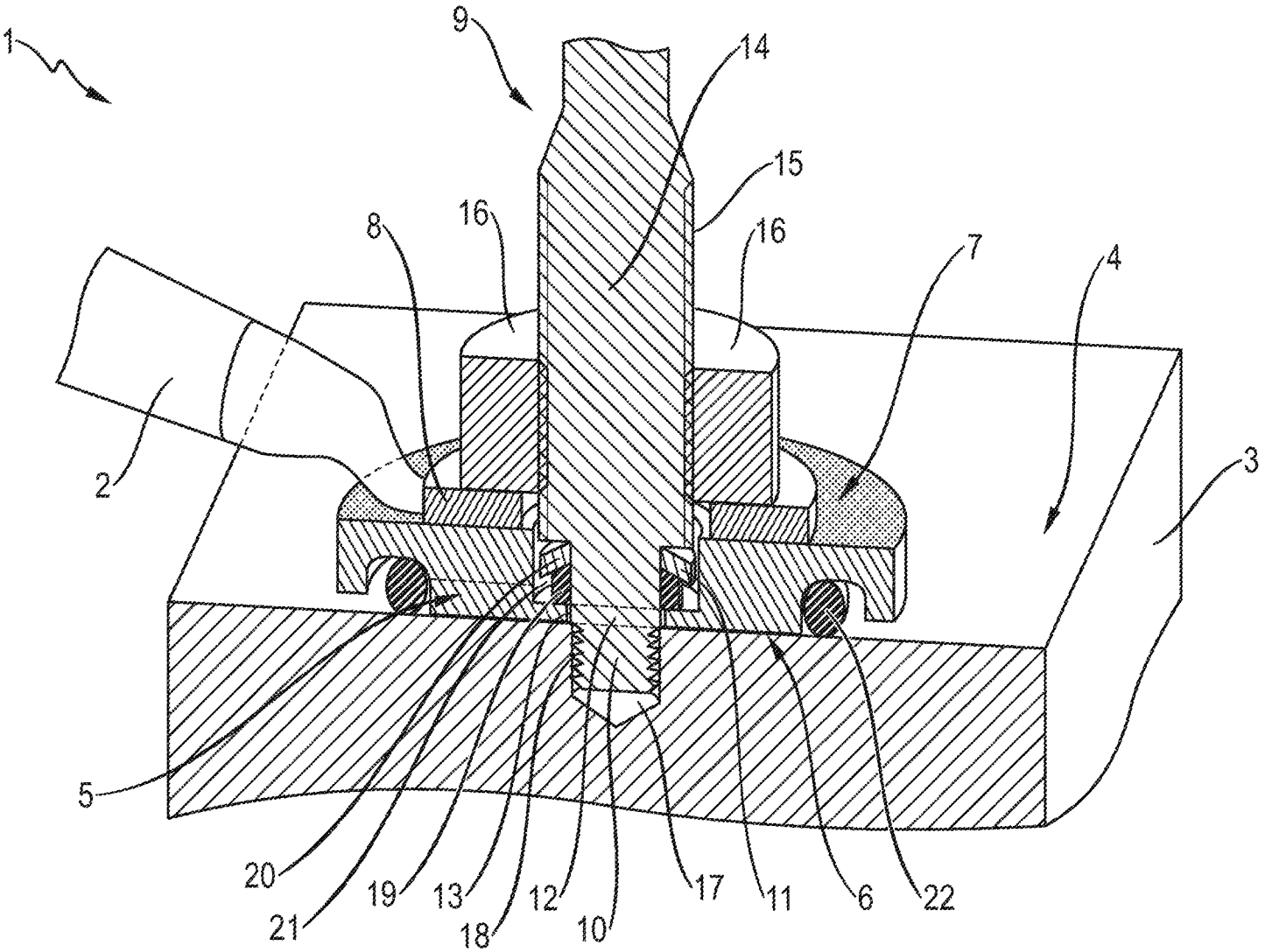
1
2
3
4
5
6
7
8
9
10
11
12
13
14
15
16
16
17
18
19
20
21
22

EARTHING CONTACT

CROSS-REFERENCE TO RELATED APPLICATIONS

This patent application is the U.S. National Stage of International Patent Application No. PCT/EP2018/059714, filed Apr. 17, 2018, which claims the benefit of European Patent Application No. 17166858.5, filed Apr. 18, 2017, which are each incorporated by reference.

The invention relates to a ground contact for creating an electrical contact between a ground cable and a component having an electrically conductive component surface.

BACKGROUND OF THE INVENTION

Ground contacts are known which have a first contact surface for application on the component surface, a second contact surface for fastening a ground cable and a passage for a fastening element, by means of which the ground contacts are attached to the component. A flat application of the first contact surface on the component surface should be ensured, for the desired electrical contact. The requirements for accuracy in fastening are therefore particularly high.

BRIEF SUMMARY OF THE INVENTION

One object of the invention is to ensure an application of the first contact surface in a flat manner on the component surface, even with inaccurate fastening.

The object is achieved by a ground contact for creating an electrical contact between a ground cable and a component having an electrically conductive component surface, with an electrically conductive contact plate and a fastening element, wherein the contact plate has a first contact surface for an application of the contact plate in a flat manner on the component surface, a second contact surface for the application of a ground cable one the contact plate and a passage for the fastening element, wherein the fastening element has a fastening section in the component for fastening the fastening element, a pressure element for pressing the contact plate to the component surface and a holding section for arranging in the passage of the contact plate when the pressure element is pressing onto the component surface, wherein the first contact surface is tiltable with respect to the fastening section by a tilting angle of at least 6°, when the holding section is arranged in the passage. An application of the first contact surface on the component surface is thereby also ensured, if the fastening element is attached to the component with an angle of up to 3° obliquely to the normal to the surface of the component surface. The first contact surface is preferably tiltable with respect to the fastening section by a tilt angle of at least 10°, more preferably by at least 20°. An application of the first contact surface to the component surface is thereby also ensured, if the fastening element is attached to the component with an angle of up to 5°, respectively up to 10° obliquely to the normal to the surface of the component surface.

According to one advantageous embodiment, the holding section is connected rigidly with the fastening section. According to another advantageous embodiment, the first contact surface is connected rigidly with the passage.

According to one advantageous embodiment, the passage is configured as a circular cylindrical bore with a bore diameter and a bore length, wherein the holding section is configured as a circular cylindrical shaft section with a shaft diameter. The ratio of the difference between the bore diameter and the shaft diameter on the one hand, and the bore length on the other hand advantageously amounts to at least 0.05, preferably at least 0.1, more preferably at least 0.2. This thereby ensures that the first contact surface is adequately tiltable with respect to the fastening section.

According to an advantageous embodiment, the pressure element is connected rigidly with the holding section. The pressure element is preferably configured as a stop shoulder on the holding section. This simplifies the construction of the ground contact.

According to an advantageous embodiment, the ground contact has a gasket, which is arranged between the pressure element and the contact plate. The sealing of the fastening section of the fastening element with respect to a sometimes-corrosive environment is thereby ensured.

According to an advantageous embodiment, the fastening element has a fastening section for fastening the ground cable to the second contact surface. The fastening section is preferably configured as a bolt section for driving into a borehole of the component. More preferably, the bolt section has in particular a self-forming thread for screwing into the borehole.

Exemplary embodiments of the invention can now be described hereafter with reference to the drawing. These need not necessarily represent the exemplary embodiments to scale; rather the drawing, where it is useful for explanation, is executed in a schematic and/or slightly distorted form. With regard to complements to the teachings directly discernible from the drawing, the relevant state of the art is referred to. It should be noted in this respect that numerous modifications and changes relating to the form and the detail of an embodiment can be undertaken without deviating from the general idea of the invention. The features of the invention disclosed in the description, in the drawing as well as in the claims, both individually and in any combination, can be essential for the further development of the invention. Moreover, all combinations of at least two of the features disclosed in the description, the drawing and/or the claims fall into the scope of the invention. The general idea of the invention is not restricted to the exact form or detail of the preferred embodiments shown and described hereafter. When dimensioning ranges are given, values lying within the stated limits can also be revealed as boundary values and be arbitrarily applicable and claimable. For the sake of simplicity, the same reference symbols are used for identical or similar parts or parts with identical or similar functions.

DESCRIPTION OF THE SEVERAL VIEWS OF THE DRAWING(S)

Additional advantages, features and particulars of the invention will be revealed by the following description of preferred embodiments and with reference to the drawing; these show, in:

FIG. 1 a ground contact.

DETAILED DESCRIPTION OF THE INVENTION

In FIG. 1 a ground contact 1 is shown for making electrical contact between a ground cable 2 and a component 3 having an electrically conductive component surface 4. The ground contact 1 includes an electrically conductive contact plate 5 with a first contact surface 6 for applying the contact plane 5 in a flat manner on the component surface 4, and a second contact surface 7 for applying the ground cable 2 to the contact plate 5. To this end, the ground cable 2 has a cable lug 8. The ground contact 1 also includes a fastening element 9 with a fastening section 10 for fastening the fastening element 9 to the component 3, a pressure element 11 configured as a stop shoulder, which presses the contact plate 5 to the component surface 4, and a holding section 12, which is arranged in a passage 13 of the contact plate 5. The ground cable 2 has a conductor cross-section of 50 $mm^2$ or more, 95 $mm^2$ for example. The first contact surface 6 has a surface area of 250 $mm^2$ or more, 400 $mm^2$ for example. The first contact surface 6 and/or the second contact surface 7 are galvanized, hot-dip galvanized for example.

The fastening section 10 is configured as a bolt section for driving into a borehole 17 of the component 3. The fastening section 10 has a self-forming thread 18 for screwing into the borehole 17. In exemplary embodiments not shown, the fastening section is configured as a blunt setting bolt without a threaded section for linear driving into the borehole, or has a screw tip or a nail tip for direction driving into a component without a borehole. Furthermore, the fastening element 9 has a fixing section 14 for fixing the ground cable 2 to the second contact surface 7. The fixing section 14 is provided with an external thread 15 for this purpose, onto which a nut 16 is screwed, which presses the cable lug 8 of the ground cable 2 against the second contact surface 7.

The ground contact 1 also has a gasket which is arranged between the pressure element 11 and the contact plate 5. For sealing the fastening section 10 of the fastening element 9 with respect to the environment, the gasket includes an inner sealing ring 19 made of an elastic material and a cover plate 20 made of a rigid material, for example of a metal or an alloy such as steel. The inner sealing ring 19, the cover plate 20, the sealing plate and/or the pressure element 11 are arranged in a recess 21 of the contact plate 5 provided for that purpose. The ground contact 1 also has an external sealing ring 22, which is so arranged between the contact plate 5 and the component 3, that the first contact surface 6 is sealed with respect to the environment. The electrical contact between the first contact surface 6 and the component surface 4 is thus protected against a sometimes-corrosive effect of the environment by the inner sealing ring 19 on the one hand and by the outer sealing ring 22 on the other hand.

The fastening element 9 is manufactured in one piece from a metal or an alloy such as steel, so that the fixing section 14, the pressure element 11, the holding section 12 and the fastening section 10 are rigidly connected to one another. Likewise, the contact plate 5 is manufactured in one piece from a metal such as copper or an alloy such as steel, so that the first contact surface 6, the second contact surface 7 and the passage 13 are rigidly connected together.

The passage 13 is configured as a circular cylindrical bore with a bore diameter of 6.0 mm and a bore length of 2.0 mm which is equal to the thickness of the contact plate 5 in the area of the passage 13. The holding section 12 is configured as a circular cylindrical shaft section with a shaft diameter of 5.6 mm. The ratio of the difference between the bore diameter and the shaft diameter, namely 0.4 mm, and the bore length, namely 2.0 mm amounts to 0.2. The first contact surface 6 is therefore tiltable with respect to the fastening section 10 by a tilt angle of approximately 11.3° in each direction, i.e. with an overall tilt angle of approximately 22.6°. In order to ensure that the first contact surface 6 lies in a flat manner on the component surface 4, it is thus sufficient that the fastening element 9 is fastened to the component 3 at an angle of 90°−11.3°=78.7° or more to the component surface 4.

The invention claimed is:

1. A ground contact for making electrical contact between a ground cable and a component with an electrically conductive component surface, comprising an electrically conductive contact plate and a fastening element, wherein the contact plate has a first contact surface for applying the contact plate to the electrically conductive component surface, a second contact surface for applying a ground cable to the electrically conductive contact plate and a passage for the fastening element, wherein the fastening element has a fastening section for fastening the fastening element to the electrically conductive component, a pressure element for pressing the electrically conductive contact plate to the electrically conductive component surface and a holding section for arranging in the passage of the electrically conductive contact plate when the pressure element presses the electrically conductive contact plate to the electrically conductive component surface, wherein the first contact surface is tiltable with respect to the fastening section by a tilt angle of at least 6°, when the holding section is arranged in the passage.

2. The ground contact according to claim 1, also having a gasket which is arranged between the pressure element and the electrically conductive contact plate.

3. The ground contact according to claim 1, wherein the fastening element has a fixing section for fixing the ground cable to the second contact surface.

4. The ground contact according to claim 1, wherein the first contact surface is tiltable with respect to the fastening section by a tilt angle of at least 10°.

5. The ground contact according to claim 4, wherein the first contact surface is tiltable with respect to the fastening section by a tilt angle of at least 20°.

6. The ground contact according to claim 1, wherein the pressure element is rigidly connected to the holding section.

7. The ground contact according to claim 6, wherein the pressure element is configured as a stop shoulder on the holding section.

8. The ground contact according to claim 1, wherein the fastening section is configured as a bolt section for driving into a borehole of the component.

9. The ground contact according to claim 8, wherein the bolt section has a self-forming thread for screwing into the borehole.

10. The ground contact according to claim 1, wherein the passage is configured as a circular cylindrical bore with a bore diameter and a bore length, and the holding section is configured as a circular cylindrical shaft section with a shaft diameter.

11. The ground contact according to claim 10, wherein a ratio of a difference between the bore diameter and the shaft diameter on the one hand, and the bore length on the other hand, amounts to at least 0.05.

12. The ground contact according to claim 11, wherein the ratio of the difference between the bore diameter and the shaft diameter on the one hand, and the bore length on the other hand, amounts to at least 0.1.

13. The ground contact according to claim 12, wherein the ratio of the difference between the bore diameter and the shaft diameter on the one hand, and the bore length on the other hand, amounts to at least 0.2.

14. The ground contact according to claim 1, wherein the holding section is connected rigidly to the fastening section.

15. The ground contact according to claim 14, wherein the first contact surface is connected rigidly with the passage.

16. The ground contact according to claim 14, wherein the first contact surface is tiltable with respect to the fastening section by a tilt angle of at least 10°.

17. The ground contact according to claim 14, wherein the passage is configured as a circular cylindrical bore with a bore diameter and a bore length, and the holding section is configured as a circular cylindrical shaft section with a shaft diameter.

18. The ground contact according to claim 1, wherein the first contact surface is connected rigidly with the passage.

19. The ground contact according to claim 18, wherein the first contact surface is tiltable with respect to the fastening section by a tilt angle of at least 10°.

20. The ground contact according to claim 18, wherein the passage is configured as a circular cylindrical bore with a bore diameter and a bore length, and the holding section is configured as a circular cylindrical shaft section with a shaft diameter.

* * * * *